US005104777A

United States Patent [19]

Schmidt et al.

[11] Patent Number: 5,104,777

[45] Date of Patent: Apr. 14, 1992

[54] PHOTOGRAPHIC ELEMENT HAVING BOTH A FILTER DYE LAYER AND A MATTE LAYER

[75] Inventors: Ronald J. Schmidt; Richard J. Kapusniak; Louis I. Nagy, all of Rochester, N.Y.

[73] Assignee: Eastman Kodak Company, Rochester, N.Y.

[21] Appl. No.: 517,280

[22] Filed: May 1, 1990

[51] Int. Cl.[5] ..... G03C 1/84

[52] U.S. Cl. ..... 430/510; 430/517; 430/523; 430/950; 430/961

[58] Field of Search ..... 430/507, 510, 517, 523, 430/531, 533, 536, 537, 539, 950, 961

[56] References Cited

U.S. PATENT DOCUMENTS

| | | | |
|---|---|---|---|
| 3,591,379 | 7/1971 | Plakunov | 96/50 |
| 3,687,703 | 8/1972 | Ohashi | 117/16 |
| 4,022,622 | 5/1977 | Timmerman et al. | 430/950 |
| 4,172,731 | 10/1979 | Heigold et al. | 430/510 |
| 4,232,116 | 11/1980 | Jamieson | 430/510 |
| 4,238,560 | 12/1980 | Nakamura | 430/162 |
| 4,264,719 | 4/1981 | Kameoka | 430/950 |
| 4,409,322 | 10/1983 | Ezaki et al. | 430/537 |
| 4,574,115 | 3/1986 | Adachi | 430/522 |
| 4,820,615 | 4/1989 | Vanderabeele et al. | 430/531 |
| 4,855,219 | 8/1989 | Bagchi | 430/496 |
| 4,904,565 | 2/1990 | Schmidt | 430/264 |
| 4,940,654 | 7/1990 | Diehl et al. | 430/510 |
| 4,988,611 | 1/1991 | Anderson et al. | 430/510 |

*Primary Examiner*—Hoa Van Le
*Attorney, Agent, or Firm*—Alfred P. Lorenzo

[57] ABSTRACT

A high-contrast room-light-handleable black-and-white photographic element is comprised of a support having on one side thereof a silver halide emulsion layer and having, on the same side of the support as the silver halide emulsion layer, both a filter dye layer in which the dye is immobile and a matte layer comprised of a matting agent dispersed in a hydrophilic colloid that serves as a binder. In this element, the filter dye layer serves to provide uniform filtering of incident light, while the matte layer provides a rough surface which facilitates rapid vacuum draw-down during contact exposure.

11 Claims, 4 Drawing Sheets

PHOTOGRAPHIC ELEMENT HAVING BOTH A FILTER DYE LAYER AND A MATTE LAYER

FIELD OF THE INVENTION

This invention relates in general to photography and in particular to black-and-white photographic elements. More specifically, this invention relates to high-contrast black-and-white photographic elements which are adapted for room-light handling and especially useful in the field of graphic arts.

BACKGROUND OF THE INVENTION

Heretofore, it has been known to employ graphic arts photographic elements which are low in photographic speed and are intended to be used under bright safelight or even ordinary room-light conditions. Such materials are referred to herein as "room-light-handleable" emulsions, elements, or materials. The term "room-light-handleable" is intended to denote that the material can be exposed to a light level of 200 lux for several minutes without a significant loss in maximum density. typically, such materials require on the order of 10,000 ergs per square centimeter for $D_{min}$ exposure.

In the field of graphic arts, it is well known to incorporate soluble dyes in an overcoat layer of a photographic element to absorb unwanted light and decrease photographic speed so that longer exposure times can be used. This technique is useful in providing high-contrast room-light-handleable black-and-white photographic elements. However, soluble dyes tend to migrate to other layers of the element such as the silver halide emulsion layer. When light passes through the emulsion layer, it encounters a concentration gradient of dye and thus more light is absorbed as it travels through the emulsion layer. The bottom of the emulsion layer encounters much less light than the top and, as a result, the contrast is reduced. Another problem is that the degree of migration of soluble dye that occurs in a photographic element is random. Accordingly, random speed variability can occur, depending on how much dye is concentrated at a particular position in the emulsion layer.

Matting agents are often used in photographic elements to provide a rough surface to the element, which is often desirable. Matting agents can provide an irregular surface to a photographic element, thereby permitting sufficient surface roughness to allow retouching or writing on the surface of the element. Surface roughness can also be desirable to prevent the surface of the photographic material from sticking to an adjacent surface and can provide a desired coefficient of friction to allow for use in apparatus for rapid handling and transport of the photographic material. Additionally, matting agents can help prevent the formation of Newton's rings when printing and enlarging because the area of contact of the surface of the photographic material with another material is relatively small due to the spacing effect of the matting agent. In lithographic photographic processes involving juxtaposing an unexposed photographic element with an original image that is desired to be copied, or an image-containing processed film element with a printing plate to impose an image on the plate, roughness on the surface of the film element imparted by a matting agent allows for relatively rapid vacuum draw-down between the film element and the original or plate.

Matting agents are usually present in a separate, overcoat layer of a photographic element, although they can be incorporated in a lower layer such as an emulsion layer or interlayer as long as they impart roughness to the element. Examples of organic matting agents are particles, often in the form of beads, of polymers such as polymeric esters of acrylic and methacrylic acid, e.g., poly(methylmethacrylate), cellulose esters such as cellulose acetate propionate, cellulose ethers, ethyl cellulose, polyvinyl resins such as poly(vinyl acetate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

It is a common practice in the photographic art to coat more than one layer of a photographic element in a single pass through a coating machine. Such multilayer coating procedures are described, for example, in U.S. Pat. Nos. 2,761,791 and 3,508,947. These multilayer coating procedures often result in savings of time, effort, and expense in the coating of photographic elements. When such multiple wet layers are coated and dried, however, the matting agent particles can be forced into the emulsion layer of the element.

When such an element is imagewise exposed and processed, the image density in the area underlying a matting agent particle that has invaded the emulsion layer is diminished compared to other areas of the emulsion that have received equivalent exposure. These areas of decreased image density appear as small spots in the image. The resulting visual effect has been called the "starry night" effect due to the similarity in appearance to a starry night sky.

The problem of migration of soluble dye throughout the photographic element can be avoided by use of a filter dye layer overlying the emulsion layer in which the dye is immobile, for example, a solid particle dispersion dye. The use of such immobile dye layers in graphic arts films is described, for example, in U.S. Pat. No. 4,904,565, issued Feb. 27, 1990. Since the dye is connected in a layer above the emulsion, the light is uniformly filtered before it reaches the emulsion layer and the result is substantial improvement in contrast and reduction in speed variability. However, if matte particles are incorporated in the immobile dye layer, they tend to displace the dye upon drying of the layer. Thus, for example, the matte particles typically have a size of one to twenty microns, while the immobile dye layer may have a thickness of only one micron. Displacement of the dye by a matte particle causes the region of the emulsion layer directly beneath the matte particle to receive more exposure than occurs in areas where there are no matte particles. This problem of dye displacement is hereinafter termed "matte punch through". In a reversal film, the practical significance of this is that, when the photographic element is subjected to sufficient low level room light, areas under matte particles are exposed while areas not under matte particles are not exposed. Upon processing, the exposed areas clear out while the unexposed areas remain at maximum density. The appearance is the same as "starry night" effect.

It is toward the objective of providing an improved photographic element which avoids both the problem of dye migration and the problem of "matte punch through" that the present invention is directed.

SUMMARY OF THE INVENTION

In accordance with this invention, a high-contrast room-light-handleable black-and-white photographic element is comprised of a support having on one side thereof a silver halide emulsion layer and having, on the same side of the support as the silver halide emulsion layer, both a filter dye layer in which the dye is immobile and a matte layer comprised of a matting agent dispersed in a hydrophilic colloid that serves as a binder.

The novel photographic element of this invention effectively avoids both the problem of dye migration and the problem of "matte punch through". Since the filter dye is immobile, there is no migration and, since the immobile filter dye is contained in a separate layer from the layer which contains the particles of matting agent, the dye is not displaced by matting agent particles during drying of the element. Thus, there is at all points over the full extent of the photographic element a substantially uniform and continuous dye layer interposed between the emulsion layer and the exposure source and, as a result, the problem of "matte punch through" is greatly reduced.

Preferably, the filter dye layer directly overlies the emulsion layer and the matte layer directly overlies the filter dye layer. In other words, the filter dye layer is preferably an interlayer and the matte layer is preferably an overcoat layer. Such a layer arrangement, while preferred, is, however, not essential since the particles of matting agent could be incorporated in an interlayer interposed between the emulsion layer and an overcoat layer containing the immobile dye as long as they are still able to impart the desired degree of surface roughness to the element. The critical requirements to achieve the objectives of this invention are that the dye be immobile and that the dye and the particles of matting agent be disposed in separate layers.

DESCRIPTION OF THE PREFERRED EMBODIMENTS

Figure 1:
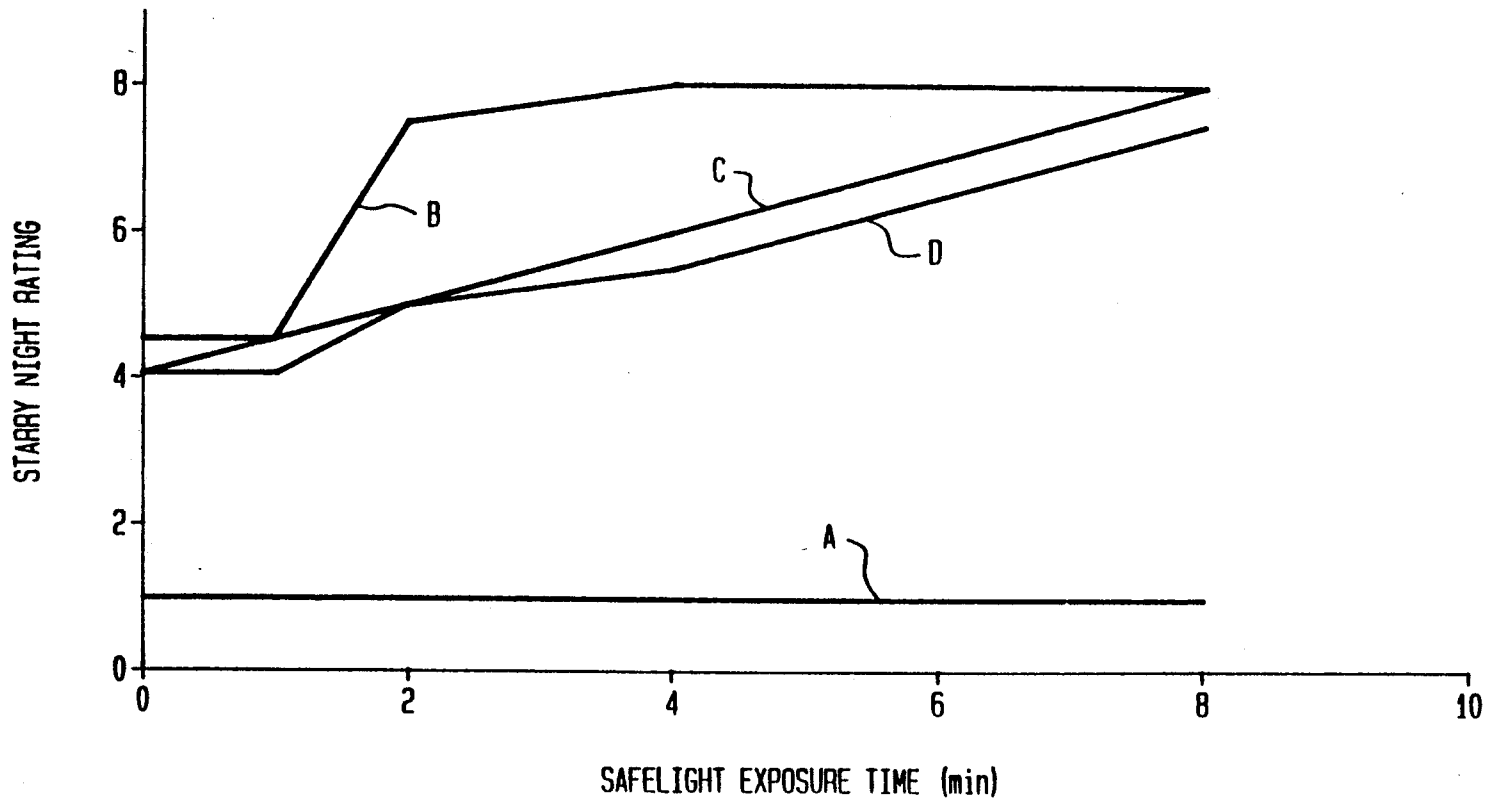
FIG. 1 is a plot of starry night rating versus safelight exposure time for two control elements and two elements within the scope of the present invention.

Silver halide emulsions useful in the high-contrast room-light-handleable black-and-white photographic elements of this invention can be surface-sensitive emulsions—i.e., emulsions that form latent images primarily on the surfaces of the silver halide grains (as typically occurs absent intentional grain modification) or internal latent image-forming emulsions—i.e., emulsions that form latent images predominantly in the interior of the silver halide grains (typically achieved by internal crystal irregularities or dopant incorporation), as illustrated by Knott et al, U.S. Pat. No. 2,456,953, Davey et al, U.S. Pat. No. 2,592,250, Porter et al, U.S. Pat. Nos. 3,206,313 and 3,327,322, Berriman, U.S. Pat. No. 3,367,778, Bacon et al, U.S. Pat. No. 3,447,927, Evans, U.S. Pat. No. 3,761,276, Morgan, U.S. Pat. No. 3,917,485, Gilman et al, U.S. Pat. No. 3,979,312 and Miller, U.S. Pat. No. 3,767,413. The emulsions can be negative-working emulsions such as surface-sensitive emulsions or unfogged internal latent image-forming emulsions, or direct-positive emulsions of the surface-fogged type, as illustrated by Kendall et al, U.S. Pat. No. 2,541,472, Shouwenaars, U. K. Patent 723,019, Illingsworth, U.S. Pat. No. 3,501,307, Berriman, U.S. Pat. No. 3,367,778, *Research Disclosure*, Vol. 134, June, 1975, Item 13452, Kurz, U.S. Pat. No. 3,672,900, Judd et al, U.S. Pat. No. 3,600,180 and Taber et al, U.S. Pat. No. 3,647,463, or of the unfogged, internal latent image-forming type, which are positive-working with fogging development, as illustrated by Ives, U.S. Pat. No. 2,563,785, Evans, U.S. Pat. Nos. 3,761,276 and 4,504,570, Knott et al, U.S. Pat. No. 2,456,953 and Jouy, U.S. Pat. No. 3,511,662.

The photographic elements of this invention are high contrast elements, with the particular contrast value, as indicated by gamma (Y), depending on the type of emulsion employed. Gamma is a measure of contrast that is well-known in the art as described, for example, in James, The Theory of the Photographic Process, 4th Ed., 502, MacMillan Publishing Co., 1977.

The useful silver halide emulsions include silver chloride, silver bromide, silver chlorobromide and silver bromoiodide emulsions.

The silver halide grains useful in the practice of the invention may be of any known configuration, including regular octahedral, cubic, or tabular grains, as described, for example, in *Research Disclosure*, Item 17643, December, 1978 [hereinafter Research Disclosure I], Section I, and *Research Disclosure*, Item 22534, January, 1983. The silver halide grains preferably have a mean grain size of not greater than about 0.7$\mu$ and more preferably of about 0.4$\mu$ or less. As is recognized in the art, higher contrasts can be achieved by using relatively monodispersed emulsions, particularly when larger grain size emulsions are employed. As used herein, the term "monodispersed" means that the emulsion has a coefficient of variation of less than about 20%. For the highest levels of contrast, the coefficient of variation is preferably less than about 10%. As used herein, the term "coefficient of variation" is defined as 100 times the standard deviation of the grain diameter divided by the mean grain diameter.

Silver halide emulsions also contain a binder or vehicle. The proportion of vehicle can be widely varied, but typically is within the range of from about 20 to 250 g/mole silver halide. The presence of excessive levels of vehicle can reduce maximum image density and, consequently, contrast. Thus, for Y values of 10 or more, the vehicle is preferably present at a level of 250 g/mole silver halide or less. The specific vehicle materials used in the emulsion and any other layers of the photographic elements of the invention can be chosen from any of a number of well-known vehicle materials. Preferred vehicles are hydrophilic binders such as water-permeable hydrophilic colloids employed alone or in combination with extenders such as synthetic polymeric peptizers, carriers, lattices, and other binders. Such materials are more specifically described in *Research Disclosure I*, Section IX. Vehicles are usually employed with one or more hardeners, such as those described in *Research Disclosure I*, Section X.

Emulsions useful in the invention may be prepared by a variety of known techniques, including single-jet precipitation, double-jet precipitation (including continuous removal techniques), and accelerated flow rate and interrupted precipitation techniques. Such techniques are well-known in the art and do not require further description herein.

For high contrast photographic materials, high levels of photographic speed are often not required. Thus, it is not necessary to chemically sensitize the silver halide emulsions, although it is acceptable to do so. Useful chemical sensitizers include one or more middle chalcogens, sulfur, selenium, and/or tellurium. Chemical sensitization can be achieved by the use of active gelatin or by the addition of middle chalcogen sensitizers, as described in *Research Disclosure I*, Section III. Reduction and other conventional chemical sensitization techniques disclosed therein that do not unacceptably reduce contrast can also be employed.

Spectral sensitization of silver halide emulsions useful in the practice of the invention is not required, but can be accomplished using conventional spectral sensitizers, singly or in combination as illustrated by *Research Disclosure I*, Section IV. For black and white imaging, orthochromatic and panchromatic sensitizations are often preferred. Useful spectral sensitizing dyes can be any of the known cationic, anionic, or nonionic cyanine or merocyanine spectral sensitizing dyes. Such dyes are further described in Hamer, Cyanine Dyes and Related Compounds, 1964.

Direct reversal emulsions that are advantageously employed in the photographic elements of this invention include those in which a polybromo coordination complex of iridium is incorporated in the silver halide grains as disclosed in copending U.S. patent application Ser. No. 455,688 filed Dec. 22, 1989, "Direct Reversal Emulsions", by Janusonis et al, the disclosure of which is incorporated herein by reference.

The filter dyes employed in the photographic elements of this invention may be essentially any dye that is useful as a photographic filter dye. These dyes include oxonols, cyanines, merocyanines, arylidenes, and the like. Such dyes are well-known in the art as disclosed, for example, in the above-referenced Hamer reference. The dyes must absorb light in the region of the spectrum to which the silver halide is sensitive and to which it will be exposed. Preferably, the dyes have absorption characteristics and are present in amounts sufficient so as to provide increased image density of an element that has been exposed and processed to achieve a halftone image having 50% black area and 50% white area (increased as compared to an element not having the filter dye interlayer). The actual amount of the dyes present will vary upon the region of the spectrum to which the silver halide is sensitive and the absorption characteristics of the particular dyes; however, the filter dyes in the unprocessed element are preferably present in an amount so as to have an absorbance density of at least 0.10 density units in the region of the spectrum where the silver halide emulsion is sensitive and is to be exposed.

The filter dyes may be diffusible or non-diffusible, but are preferably solubilizable during photographic processing for decolorization and/or removal. Water soluble dyes may be used for this purpose. Such dyes are preferably incorporated in the photographic element with a mordant to prevent dye wandering prior to photographic processing. Useful dyes include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897, 3,652,284, and 3,718,472, the enamino hemioxonol dyes of U.S. Pat. No. 3,976,661, as well as ultraviolet absorbers, such as the cyanomethyl sulfone-derived merocyanines of U.S. Pat. No. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 3,215,597, and 4,045,229. Useful mordants are described, for example, in U.S. Pat. Nos. 3,282,699, 3,455,693, 3,438,779, and 3,795,519.

In a preferred embodiment of this invention, the filter dyes are solid particle dispersion filter dyes, as described in U.S. Pat. Nos. 4,092,168 and PCT Application Publication No. WO88/04794, the disclosures of which are incorporated herein by reference. Such dyes can be described by the formula:

$$[D-(A)_y]-X_n \qquad (I)$$

where D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 8 or above. In dyes according to formula (I), X preferably has a pKa of 4 to 11 in a 50/50 volume basis mixture of ethanol and water. The dyes according to formula (I) also preferably have a log partition coefficient (log P) of from 0 to 6 when X is in unionized form.

Solid particle dispersion dyes according to formula (I) offer the advantage of being insoluble and non-diffusible in photographic elements at coating pH's, but soluble for decolorization and/or removal at photographic processing pH's. This is especially advantageous in the photographic elements of the present invention, which have at least one filter dye in a layer of the element disposed on the same side of the support as the silver halide emulsion. Mordanted soluble dyes in such a layer can be difficult to remove or decolorize during photographic processing, and unmordanted soluble dyes wander to other layers of the element, adversely affecting the sensitometric properties of the emulsion layer(s).

Examples of filter dyes according to formula (I) include the following:

(1)

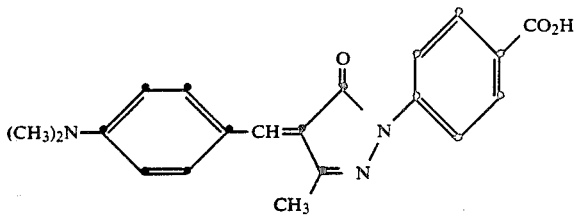

(2)

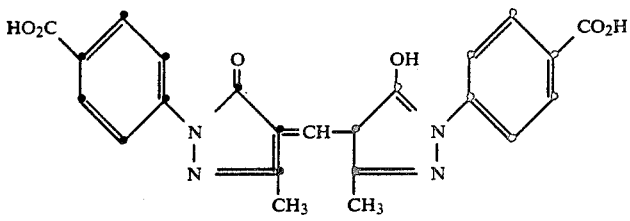

(3)

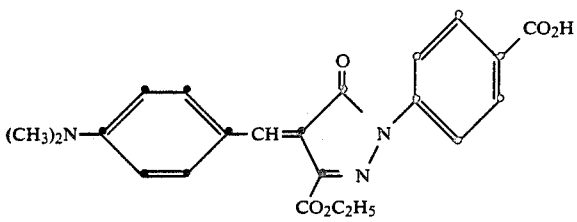

(4)

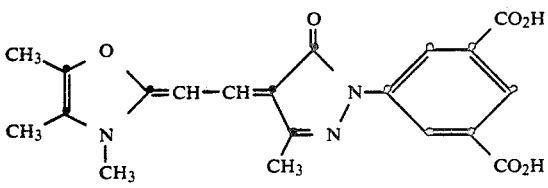

(5)

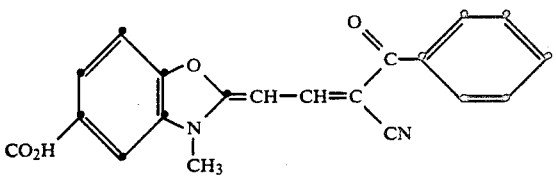

(6)

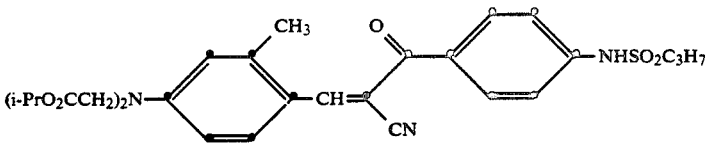

Other dyes according to formula (I) are described in the above-referenced U.S. Pat. No. 4,092,168 and WO 88/04794.

The filter dye layer of this invention typically has a thickness in the range of from about 0.5 to about 5 microns, more typically about 0.8 to about 3 microns.

In addition to the components of the photographic emulsions and other hydrophilic colloid layers described above, other conventional element addenda and layers compatible with obtaining relatively high contrast images can be present. For example, the photographic element of the invention can contain developing agents, development modifiers, plasticizers and lubricants, coating aids, antistatic materials, and the like, as illustrated in *Research Disclosure I.*

The element of the invention may also contain a hydrazine compound in order to achieve high contrast. Such hydrazine compounds are known in the art, as disclosed in U.S. Pat. No. 4,650,746.

As lithographic-type photographic elements, the elements of the invention are preferably utilized (exposed and processed) as sheet films. As such, the elements preferably have low curl (i.e., less than about 40 ANSI curl units at 21° C. and 15% relative humidity, using ANSI PH 1.29-1971, which calls for matching the curl of sample strips on a template of curves of varying radii to determine the radius of curvature and reporting the value of 100/R as the degree of curl where R is the radius of curvature in inches) and high dimensional stability (humidity coefficient, defined as % change in linear dimension divided by change in percent humidity over a 15–50% relative humidity range at 21° C., of less than about 0.0015).

The element of the invention may be processed by any processing technique known to be useful for processing of elements to achieve high contrast images. The processing solutions generally contain a hydroquinone developing agent, although any known developing agent may be used. If the developing agent is incorporated in the element, the element can be processed in an activator solution, which is identical to a developing solution in composition but lacking a developing agent, as described in U.S. Pat. No. 4,385,108. Depending on the element, the developing solution can be especially adapted for producing high contrast images or it can be a conventional developing solution useful for processing a wide variety of photographic elements. As an alternative to incorporating a hydrazine compound in the photographic element, it may also be incorporated in the processing solution. Useful developing solutions are described in J.A.C. Yule, Journal of the Franklin Institute, Vol. 239, 221-30 (1945), U.S. Pat. Nos. 2,410,690, 2,419,974, 2,419,975, 2,882,152, 2,892,715, 3,573,914, 4,022,621, 4,269,929, GB 1,359,444, and Stauffer, Smith, and Trivelli, Journal of the Franklin Institute, Vol. 238, 291-98 (1944).

Direct reversal emulsions employed in this invention can be surface fogged with known reducing agents, such as thioureadioxide, amine boranes, borohydrides and tin compounds, and by other known ways.

The useful photographic elements include elements prepared from any of a wide variety of photographic supports. Typical photographic supports include polymeric film, wood fiber—e.g., paper, metallic sheet and foil, glass and ceramic supporting elements, and the like.

Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo and co-polymers of olefins, such as polyethylene and polypropylene and polyesters of dibasic aromatic carboxylic acids with divalent alcohols such as poly(ethylene terephthalate).

Typical of useful paper supports are those which are partially acetylated or coated with baryta and/or a polyolefin, particularly a polymer of an alpha-olefin containing 2 to 10 carbon atoms in the repeating unit, such as polyethylene, polypropylene, copolymers of ethylene and propylene and the like.

Polyester films, such as films of polyethylene terephthalate, have many advantageous properties, such as excellent strength and dimensional stability, which render them especially advantageous for use as supports in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known in the art and include any glycol, wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacis acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclohexanedimethanol. U.S. Pat. NO. 2,901,466 discloses polyesters prepared from 1,4-cyclohexanedimethanol and their method of preparation.

The thickness of the polyester sheet material employed in carrying out this invention is not critical. For example, polyester sheeting of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

As described hereinabove, matting agents are very well known in the photographic art and can be beads of an organic polymeric material such as poly(methyl methacrylate) beads or particles of an inorganic material such as calcium carbonate. Any of the many matting agents known to the photographic art can be used in the matte layer of this invention.

The matte layer employed in this invention, whether it incorporates organic or inorganic matting agents, also includes a hydrophilic colloid which serves as a binder. The binder is preferably gelatin, but many other suitable binders are also known to the photographic art and can be used alone or in combination with gelatin. Suitable hydrophilic colloids for use in a matte layer include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin, and the like.

Polymer particles useful as matte agents in the present invention can be of essentially any shape. Useful particles will generally have a mean diameter in the range of 1 to 20 microns. Especially preferred are particles having a mean diameter of from 4 to 8 microns. Mean diameter of a particle is defined as the diameter of a spherical particle of identical mass. In some embodiments of the invention, it is preferable to have polymer particles that are in the form of spherical beads having diameters in the size ranges described above.

The polymer particles can be prepared by techniques well-known in the art, such as by polymerization followed by grinding or milling to obtain the desired particle size, or more preferably by emulsion or suspension polymerization procedures whereby the desired particle size can be produced directly as stable dispersions.

Emulsion polymerization techniques can be employed to produce particle sizes ranging from about 0.01 to 5 μm (preferably about 0.1 to 2.5 μm) as stable aqueous dispersions that can be coated directly without isolation. Larger size particles, i.e., over about 3 μm are preferably prepared by suspension polymerization, often in an organic solvent system from which the particles are isolated and resuspended in water for most economic coating procedures, or most preferably by "limited coalescence" procedures taught by U.S. Pat. No. 3,614,972. The bulk, emulsion, and suspension polymerization procedures are well-known to those skilled in the polymer art and are taught in such textbooks as W. P. Sorenson and T. W. Campbell, "Preparation Methods of Polymer Chemistry", 2nd ed., Wiley (1968) and M. P. Stevens, "Polymer Chemistry—An Introduction", Addison Wesley Publishing Co. (1975).

The invention is further illustrated by the following examples of its practice.

Element A, which is employed herein as a control, is comprised of a poly(ethylene terephthalate) film support, a silver halide emulsion layer overlying the film support, and a protective overcoat layer overlying the silver halide emulsion layer. The silver halide emulsion layer is comprised of a direct reversal emulsion as described in Example 1 of copending U.S. Pat. application Ser. No. 455,688, filed Dec. 22, 1989, to which reference has been made hereinabove, and the protective overcoat layer is comprised of gelatin containing solid particle dispersion dye No. 1 as identified hereinabove.

Element B, which is employed herein as a control, is identical to element A, except that poly(methyl methacrylate) beads ranging in size from 1 to 20 microns were incorporated, as a matting agent, in the protective overcoat layer together with the solid particle dispersion dye. In element B, the poly(methyl methacrylate) beads were employed at a concentration of 10 milligrams per square meter. In an otherwise identical element, referred to herein as element B', the poly(methyl methacrylate) beads were employed at a concentration of 20 milligrams per square meter.

Element C, which is within the scope of the present invention, is comprised of a poly(ethylene terephthalate) film support, a silver halide emulsion layer overlying the film support, a filter dye layer overlying the silver halide emulsion layer, and a matte layer overlying the filter dye layer. The silver halide emulsion layer is the same as that of element A. The filter dye layer had a thickness of approximately 1.5 microns, and was composed of solid particle dispersion dye No. 1 in a mixture of gelatin and a polymer latex that served as a gelatin extender. The matte layer contained poly(methyl methacrylate) beads ranging in size from 1 to 20 microns incorporated in gelatin at a concentration of 10 milligrams per square meter. In an otherwise identical element, referred to herein as element C', the poly(methyl methacrylate) beads were employed at a concentration of 20 milligrams per square meter.

Elements D and D', which are within the scope of the present invention, are identical to elements C and C', respectively, except that the filter dye layer had a thickness of approximately 3 microns.

Elements A through D were evaluated for matte punch through by two tests. In the first test, the severity of starry night as the film is exposed to longer safelight times is rated on a subjective scale extending from 1 to 8, with 1 representing no starry night effect and 8 the most severe starry night effect. In the second test, the $D_{max}$ of the film is determined by means of a densitometer. As the starry night effect gets worse, $D_{max}$ will decrease.

FIG. 1 is a plot of starry night rating versus safelight exposure time for elements A, B, C and D. As shown by FIG. 1, element A does not exhibit starry night effect, since no matting agent was included, and thus has a rating of 1. This element, however, lacks the advantageous properties provided by the use of matting agents, such as improved vacuum draw-down during contact exposure. Element B, which is outside the scope of the present invention, provides the highest starry night ratings. In this element, the filter dye and the particles of matting agent are in the same layer, and this leads to a severe problem of matte punch through. Elements C and D, which are within the scope of the present invention, exhibit substantially improved starry night ratings are compared to Element B, especially in the range of moderate safelight exposure times of 1 to 5 minutes. In these elements, the filter dye and the particles of matting agent are, in accordance with the invention, in separate layers and this is very effective in avoiding the most severe consequences of matte punch through. Somewhat better ratings are obtained with Element D because of the thicker filter dye interlayer.

Figure 2:
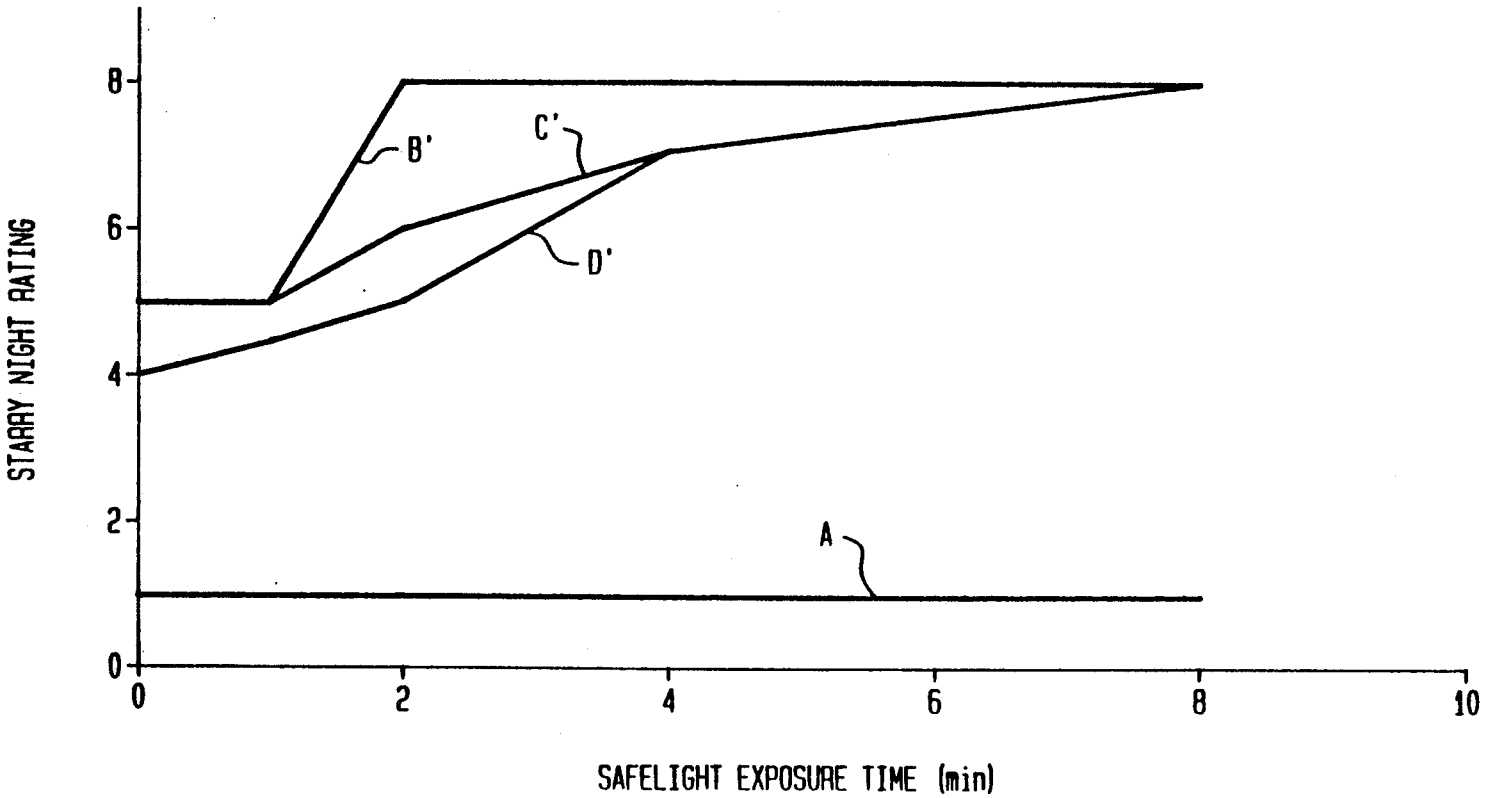
FIG. 2 is a similar plot to FIG. 1 but relates to elements with a higher concentration of matting agent particles.

FIG. 2 is a plot of starry night rating versus safelight exposure time for elements A, B', C' and D'. As shown by FIG. 2, the results obtained were comparable to FIG. 1, except that the starry night ratings for B', C' and D' were somewhat higher than for B, C and D because of the higher concentration of matting agent particles.

Figure 3:
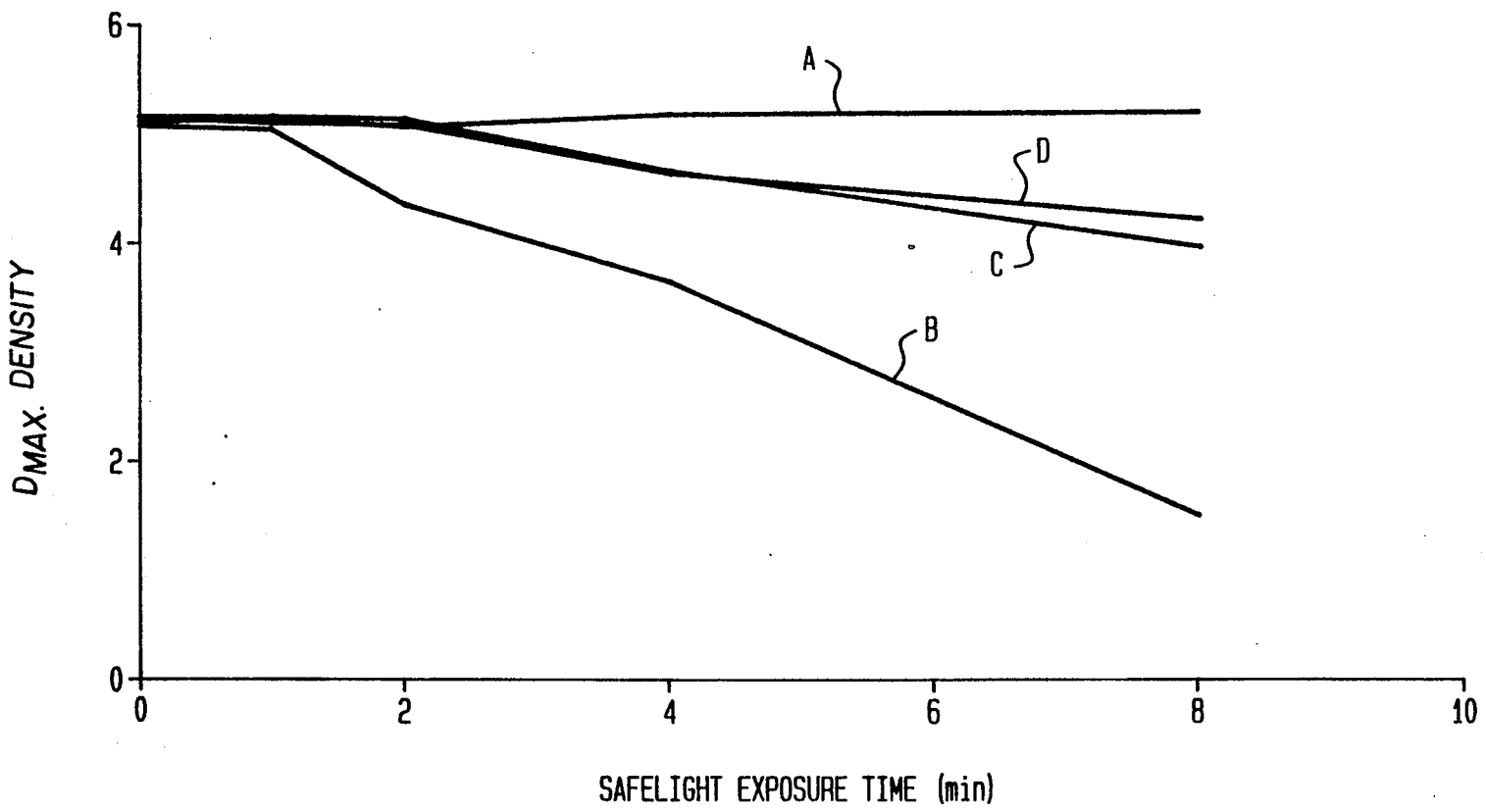
FIG. 3 is a plot of $D_{max}$ density versus safelight exposure time for two control elements and two elements within the scope of the present invention.

FIG. 3 is a plot of $D_{max}$ density versus safelight exposure time for elements A, B, C and D. As shown by FIG. 3, element A does not undergo any decrease in $D_{max}$ density, since no matting agent was included. Elements B, C and D all show a decline in $D_{max}$ density, but the decline is much less for elements C and D than for element B.

Figure 4:
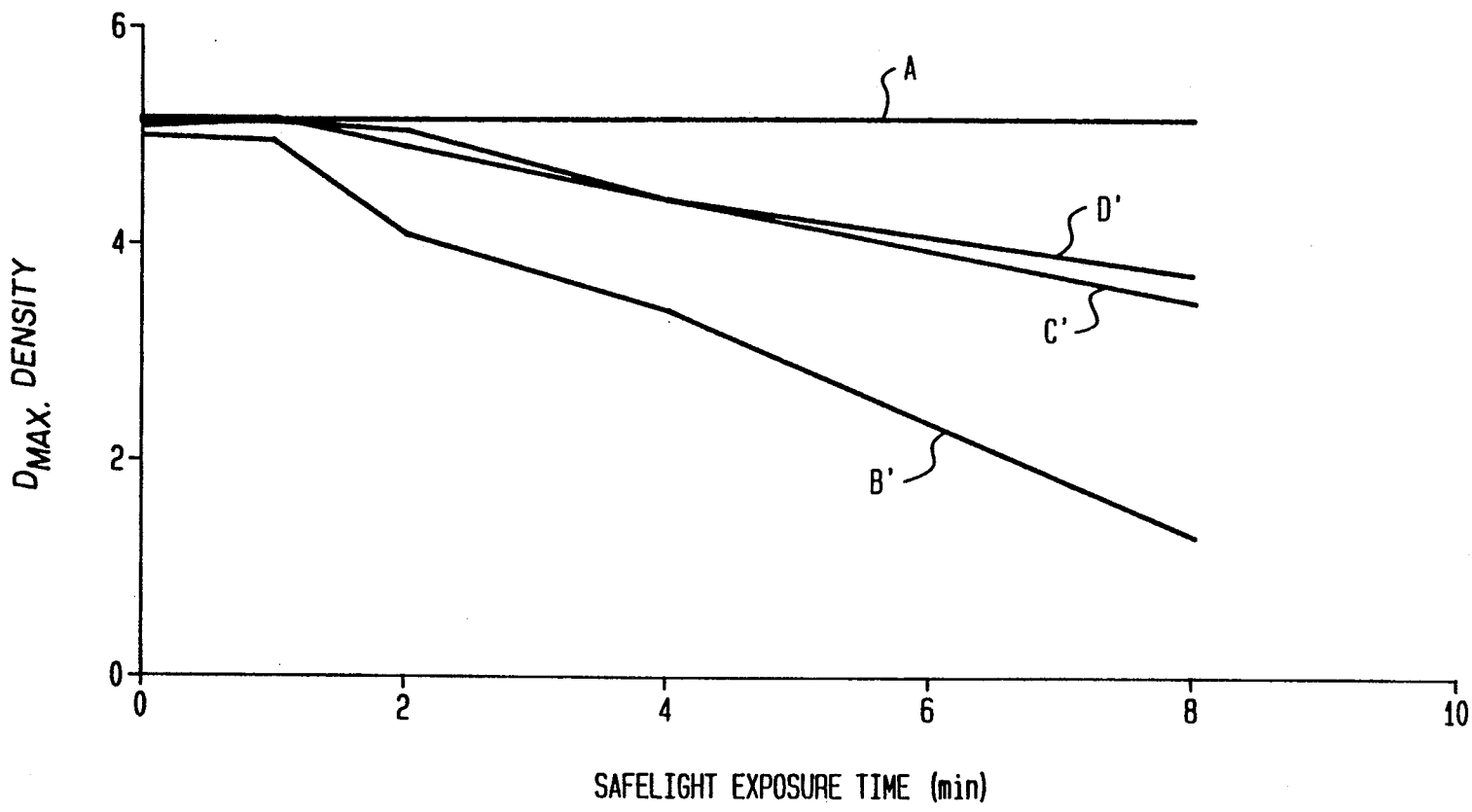
FIG. 4 is a similar plot to FIG. 3, but relates to elements with a higher concentration of matting agent particles.

FIG. 4 is a plot of $D_{max}$ density versus safelight exposure time for elements A, B', C' and D'. As shown by FIG. 4, the results obtained were comparable to FIG. 3, except that the declines for B', C' and D' were somewhat greater than for B, C and D because of the higher concentration of matting agent particles.

In the present invention, the filter dye is immobile and it is in a separate layer from the layer which contains the particles of matting agent. This does not eliminate the problem of matte punch through, but it reduces its severity. The particles of matting agent do not wholly displace the dye, as can occur when dye and matting agent are in the same layer. For example, when the particles of matting agent are in an overcoat layer and the immobile dye is in an interlayer, when the element is dried the particles of matting agent tend to squeeze down on the interlayer and locally deform it, but there is still a continuous layer of dye interposed between each particle and the underlying emulsion layer.

The invention has been described in detail with particular reference to preferred embodiments thereof, but it will be understood that variations and modifications can be effected within the spirit and scope of the invention.

We claim:

1. A high-contrast room-light-handleable black-and-white photographc element comprising a support having on one side thereof a silver halide emulsion layer and, overlying said silver halide emulsion layer, both a filter dye layer in which the dye is immobile and a matte layer comprised of matting agent particles dispersed in a hydrophilic colloid that serves as a binder, said filter dye layer being of sufficient thickness in relation to the size of said particles to prevent significantly greater exposure of said emulsion layer in regions beneath said particles than in regions that are free of said particles.

2. A high contrast photographic element as claimed in claim 1 wherein said matte layer is an overcoat layer and said filter dye layer is an interlayer interposed between said matte overcoat layer and said silver halide emulsion layer.

3. A high contrast photographic element as claimed in claim 1 wherein said filter dye layer is an overcoat layer and said matte layer is an interlayer interposed between said filter dye overcoat layer and said silver halide emulsion layer.

4. A high contrast photographic element as claimed in claim 1 wherein said support is a polyester film.

5. A high contrast photographic element as claimed in claim 1 wherein said support is a poly(ethylene terephthalate) film.

6. A high contrast photographic element as claimed in claim 1 wherein said filter dye layer comprises a dispersion in a hydrophilic binder of solid particles of a dye having the formula:

$$[D-(A)_y]-X_n$$

wherein

D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, wherein the dye is substantially aqueous insoluble at a pH of 6 or below and substantially aqueous soluble at a pH of 8 or above.

7. A high contrast photographic element as claimed in claim 1 wherein said matting agent consists of particles having a mean diameter in the range of 1 to 20 microns.

8. A high contrast photographic element as claimed in claim 1 wherein said matting agent consists of particles having a mean diameter in the range of 4 to 8 microns.

9. A high contrast photographic element as claimed in claim 1 wherein said matte layer is comprised of poly(methyl methacrylate) beads dispersed in gelatin.

10. A high contrast photographic element as claimed in claim 1 wherein said filter dye layer has a thickness in the range of from about 0.5 to about 5 microns.

11. A high contrast photographic element as claimed in claim 1 wherein said filter dye layer has a thickness in the range of from about 0.8 to about 3 microns.

* * * * *